United States Patent [19]

Bouchard et al.

[11] 4,441,475

[45] Apr. 10, 1984

[54] SUPPLEMENTARY FUEL SYSTEM FOR ENHANCING LOW TEMPERATURE ENGINE OPERATION

[75] Inventors: Patrick M. Bouchard, Sterling Heights; Jack B. King, Troy, both of Mich.

[73] Assignee: General Motors Corporation, Detroit, Mich.

[21] Appl. No.: 396,858

[22] Filed: Jul. 9, 1982

[51] Int. Cl.[3] ..... F02M 21/02

[52] U.S. Cl. ..... 123/525; 123/179 G; 123/180 R; 123/576; 123/577; 123/578; 48/189

[58] Field of Search ..... 123/525, 527, 1 A, 179 G, 123/179 L, 576, 578, 180 R, 180 AC; 48/189.1

[56] References Cited

U.S. PATENT DOCUMENTS

| | | | |
|---|---|---|---|
| 3,540,419 | 11/1970 | Fox | 123/27 GE |
| 3,738,334 | 6/1973 | Farr | 123/557 |
| 3,789,820 | 2/1974 | Douglas et al. | 123/1 A |
| 4,068,639 | 1/1978 | Cook | 123/1 A |
| 4,364,370 | 12/1982 | Smith et al. | 123/1 A |
| 4,369,751 | 1/1983 | Batchelor et al. | 48/180 C |
| 4,370,969 | 2/1983 | Zarrelli et al. | 48/180 R |

*Primary Examiner*—E. Rollins Cross

*Attorney, Agent, or Firm*—C. K. Veenstra

[57] ABSTRACT

A supplementary fuel system adds propane to the induction passage of an ethanol fueled engine to start and sustain operation of the engine at low temperatures. The propane flow is cycled on and off during cranking of the engine and the propane delivery pressure is varied with induction passage pressure.

1 Claim, 1 Drawing Figure

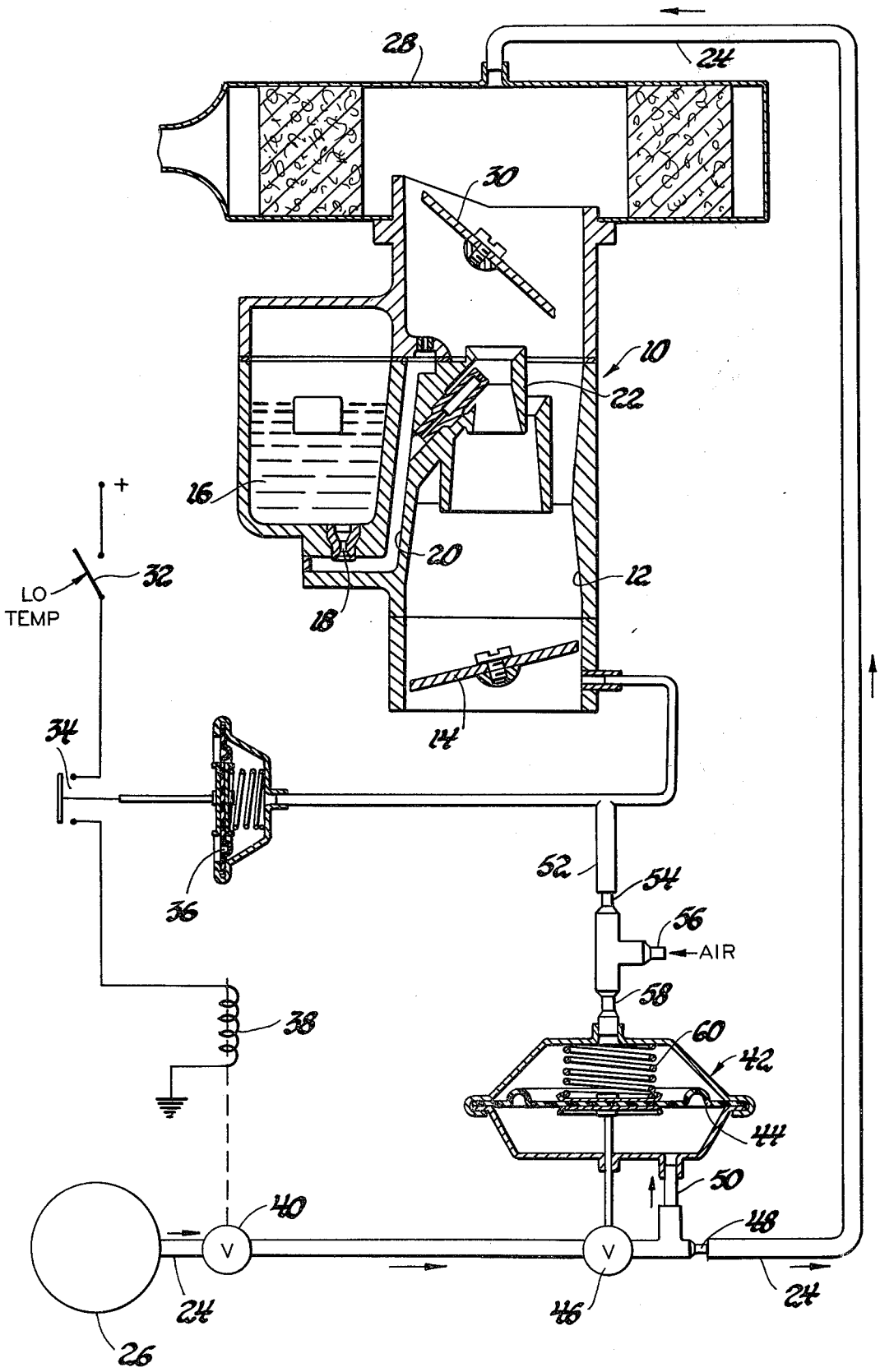
28
24
30
10
22
16
20
12
18
14
+
LO
TEMP
32
34
36
52
54
56
AIR
58
38
60
42
44
50
40
48
V
V
24
46
24
26

SUPPLEMENTARY FUEL SYSTEM FOR ENHANCING LOW TEMPERATURE ENGINE OPERATION

TECHNICAL FIELD

This invention relates to a system for enhancing low temperature operation of an engine supplied with a low volatility fuel.

BACKGROUND

Engines fueled with ethanol have proven difficult to start at temperatures less than about 25° C. because at low temperatures ethanol does not produce sufficient vapor to support combustion. The current practice for starting ethanol fueled engines at low temperatures is to discharge a quantity of gasoline into the engine induction system; a fraction of the gasoline evaporates sufficiently to start the engine, and the subsequent increase in engine temperature is sufficient to run the engine on ethanol.

The system in current use requires the operator to prime the engine with a quantity of gasoline before starting the engine. To start and sustain operation of the engine, the operator must estimate the quantity of gasoline which should be added before the engine is started. If the operator does not add sufficient gasoline, the engine may start but subsequently stall as the engine throttle is opened. If the operator adds excess gasoline, the engine may operate satisfactorily, but the excess gasoline will be wasted.

SUMMARY OF THE INVENTION

This invention provides an improved system for starting and sustaining operation at low temperatures of an engine fueled with ethanol or other low volatility fuels.

In a system employing this invention, a gaseous fuel such as propane is delivered to the engine induction system when starting the engine at low temperatures. A valve is provided to permit flow through the gaseous fuel passage only when the pressure in the engine induction passage downstream of the throttle drops below a level which indicates that air is flowing to the engine. This valve cycles open and closed in accordance with the variations in induction passage pressure which occurs during engine starting and thereby limits the gaseous fuel flow as required for starting.

As noted above, a cold engine may run satisfactorily on ethanol but may tend to stall as the engine throttle is opened because the low volatility ethanol is often unable to provide sufficient vapor to satisfy the increased requirement for fuel. In a system according to this invention, however, delivery of the gaseous fuel continues during low temperature engine operation and the gaseous fuel delivery pressure is varied with the induction passage pressure. The gaseous fuel flow is thereby increased as the throttle is opened to increase air flow, and the increased gaseous fuel flow supplements the increased flow of ethanol which occurs as the throttle is opened to thereby provide sufficient fuel vapor to enable acceleration of the engine.

The details as well as other features and advantages of the preferred embodiment of this invention are set forth in the remainder of the specification and are shown in the accompanying drawing.

SUMMARY OF THE DRAWING

The sole FIGURE of the drawing is a schematic view of the preferred embodiment of this invention.

THE PREFERRED EMBODIMENT

Referring to the drawing, a carburetor 10 for an ethanol fueled engine includes an induction passage 12 for air flow to the engine and a throttle 14 to control air flow through induction passage 12. Carburetor 10 also includes a fuel bowl 16 containing liquid ethanol which is discharged in a conventional manner through a metering orifice 18 and a fuel passage 20 leading to a venturi cluster 22 in induction passage 12. There the ethanol is mixed with the air flow to provide an air-fuel mixture for combustion in the engine. Carburetor 10 also includes other conventional elements such as an accelerator pump.

A delivery line 24 extends from a tank 26 to the carburetor air cleaner 28 to deliver propane or other gaseous fuel through air cleaner 28 and past the carburetor choke 30 into induction passage 12. Choke 30 is operated by a conventional automatic choke mechanism (not shown) but, in this application, rotational travel of choke 30 is limited to prevent closure of choke 30 beyond the position shown.

In operation, a switch 32 closes when the engine coolant temperature is below about 25° C., and a switch 34 is operated by a diaphragm 36 to close when the pressure in induction passage 12 downstream of throttle 14 drops to about −4 kPa (when manifold vacuum increases to about 4 kPa). Closure of switches 32 and 34 energizes a coil 38, to open a valve 40 which then permits gaseous fuel flow through line 24.

As the engine is cranked during the starting procedure, the induction passage pressure rises above and falls below the −4 kPa level and diaphragm 36 repeatedly closes and opens switch 34. Coil 38 thereupon cycles valve 40 opened and closed to permit a limited gaseous fuel flow through line 24. The gaseous fuel flow supplements the ethanol drawn from carburetor fuel bowl 16 during engine cranking, and sufficient fuel vapor is thereby provided in induction passage 12 to enable starting of the engine.

Once the engine has started to run, the induction passage pressure remains below −4 kPa (the manifold vacuum remains above 4 kPa), and diaphragm 36 holds switch 34 closed so that coil 38 holds valve 40 open.

A pressure regulator 42 includes a diaphragm 44 which operates a valve 46 to control the gaseous fuel delivery pressure in line 24 between valve 46 and a restriction 48. A branch 50 subjects the lower surface of diaphragm 44 to the gaseous fuel delivery pressure, while a line 52 connects the upper surface of diaphragm 44 to induction passage 12 downstream of throttle 14. Line 52 includes a restriction 54 and a bleed 56 to increase the subatmospheric pressure signal (reduce the manifold vacuum signal) received from induction passage 12 and a restriction 58 to dampen fluctuations in that signal.

Thus with this construction, pressure regulator 42 varies the gaseous fuel delivery pressure with the induction passage pressure. When the engine is not running and the induction passage pressure is atmospheric, a spring 60 in pressure regulator 42 causes pressure regulator 42 to attempt to provide a gaseous fuel delivery pressure of, for example, 41.5 kPa. When the engine is running and the induction passage pressure is −50 kPa (a manifold vacuum of 50 kPa), pressure regulator 42 maintains a gaseous fuel delivery pressure of, for example, 10 kPa. Thus as throttle 14 is opened to increase air flow through induction passage 12, pressure regulator valve 46 opens to increase the gaseous fuel delivery pressure. Gaseous fuel flow is thereby increased with engine air flow to assure sufficient fuel vapor to accelerate the engine without stalling.

When the engine has warmed sufficiently to assure satisfactory operation on the ethanol or other low volatility fuel in carburetor fuel bowl 16, switch 32 is opened to deenergize coil 38 and close valve 40 to cut off the supplementary gaseous fuel flow. In some applications switch 32 may be a timed switch sensitive to temperature and could open, for example, after 15 seconds of operation at a temperature of 0° C. and after 30 seconds of operation at a temperature of −10° C.

The embodiments of the invention in which an exclusive property or privilege is claimed are defined as follows:

1. A supplementary fuel system for an engine having an induction passage for air flow to the engine, a throttle in said induction passage, and a primary fuel system adapted to deliver a low volatility fuel to the engine, said supplementary fuel system comprising a fuel passage adapted to deliver a gaseous fuel to said induction passage, a normally closed valve controlling gaseous fuel flow through said fuel passage, means for enabling opening of said valve at temperatures below a certain level, means responsive to the pressure in said induction passage downstream of said throttle for effecting closing of said valve to interrupt fuel flow through said fuel passage as said induction passage pressure increases above a predetermined level and for effecting opening of said valve to admit fuel through said fuel passage as said induction passage pressure decreases below said predetermined level, whereby said valve cycles open and closed as said induction passage pressure varies while cranking the engine at temperatures below the certain level to limit the gaseous fuel flow as required for engine starting and whereby said valve remains open while the engine is running at temperatures below the certain level, and a pressure regulator controlling gaseous fuel flow through said fuel passage and adapted to maintain the pressure in said fuel passage proportional to the pressure in said induction passage downstream of said throttle whereby fuel flow through said fuel passage increases with air flow through said induction passage to operate the engine at temperatures below the certain level without stalling.

* * * * *